US010107244B2

(12) United States Patent
De Luca et al.

(10) Patent No.: US 10,107,244 B2
(45) Date of Patent: Oct. 23, 2018

(54) PUMP UNIT FOR SUPPLYING FUEL, PREFERABLY DIESEL OIL, TO AN INTERNAL COMBUSTION ENGINE

(71) Applicant: Robert Bosch GmbH, Stuttgart (DE)

(72) Inventors: Alessandro De Luca, Palese Macchie-Bari (IT); Vincenzo Minunno, Bitonito (IT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 15/517,943

(22) PCT Filed: Sep. 28, 2015

(86) PCT No.: PCT/EP2015/072249

§ 371 (c)(1),
(2) Date: Apr. 7, 2017

(87) PCT Pub. No.: WO2016/055294

PCT Pub. Date: Apr. 14, 2016

(65) Prior Publication Data

US 2017/0306910 A1 Oct. 26, 2017

(30) Foreign Application Priority Data

Oct. 9, 2014 (IT) ..... MI2014A1771

(51) Int. Cl.
*F02M 59/02* (2006.01)
*F04B 1/06* (2006.01)
(Continued)

(52) U.S. Cl.
CPC ..... *F02M 59/027* (2013.01); *F02M 59/06* (2013.01); *F02M 59/102* (2013.01);
(Continued)

(58) Field of Classification Search
CPC .. F02B 1/06; F02B 1/063; F04B 23/10; F04B 23/106; F04B 23/168; F02M 55/025;
(Continued)

(56) References Cited

U.S. PATENT DOCUMENTS 5,404,855 A * 4/1995 Yen ..... F02M 41/16 123/446
5,775,203 A * 7/1998 Osborn ..... F02M 59/102 417/470

(Continued)

FOREIGN PATENT DOCUMENTS

EP 0304741 A1 3/1989
EP 2535553 12/2012

(Continued)

OTHER PUBLICATIONS

International Search Report for Application No. PCT/EP2015/072249 dated Dec. 14, 2015 (3 pages).

*Primary Examiner* — John Kwon
*Assistant Examiner* — Johnny H Hoang
(74) *Attorney, Agent, or Firm* — Michael Best & Friedrich LLP

(57) ABSTRACT

A pump unit for supplying fuel, preferably diesel oil, to an internal combustion engine has at least two cylinders (10), which are formed in at least one head (9), are slidingly engaged by respective pistons (13), and communicate hydraulically with respective fuel inlets (11) in the cylinders (10) via respective interposed intake valves (15) provided with respective valve bodies (16) incorporated in the head (9); the inlets (11) of all the cylinders (10) being closed by a single cover (33) fixed to the head (9).

12 Claims, 1 Drawing Sheet

(51) Int. Cl.

| | |
|---|---|
| ***F02M 59/10*** | (2006.01) |
| ***F04B 1/04*** | (2006.01) |
| ***F04B 53/00*** | (2006.01) |
| ***F04B 53/16*** | (2006.01) |
| ***F02M 59/06*** | (2006.01) |
| ***F02M 59/46*** | (2006.01) |
| ***F02M 59/48*** | (2006.01) |
| *F04B 23/10* | (2006.01) |

(52) U.S. Cl.

CPC ..... *F02M 59/105* (2013.01); *F02M 59/464* (2013.01); *F02M 59/48* (2013.01); *F04B 1/04* (2013.01); *F04B 1/0421* (2013.01); *F04B 1/063* (2013.01); *F04B 53/007* (2013.01); *F04B 53/16* (2013.01); *F04B 23/106* (2013.01); *F04B 53/168* (2013.01)

(58) Field of Classification Search

CPC .... F02M 59/02; F02M 59/027; F02M 59/105; F02M 59/368; F02M 59/46; F02M 59/464; F02M 63/0225; F02D 41/38; F02D 41/3836; F02D 41/3845

USPC ..... 123/257, 295–499, 508; 417/475, 494, 417/521

See application file for complete search history.

(56) References Cited

U.S. PATENT DOCUMENTS

| | | | | |
|---|---|---|---|---|
| 7,513,756 | B2 * | 4/2009 | Aoki | F02M 47/027 417/470 |
| 7,819,107 | B2 * | 10/2010 | Stockner | F02M 59/44 123/445 |
| 8,308,450 | B2 * | 11/2012 | Shaull | F04B 53/04 417/366 |
| 8,960,159 | B2 * | 2/2015 | Jones | F04B 1/0413 123/198 DA |
| 2008/0213112 | A1 * | 9/2008 | Lucas | F02M 59/02 417/471 |
| 2009/0110575 | A1 * | 4/2009 | Munakata | B23K 11/16 417/437 |
| 2009/0114292 | A1 | 5/2009 | Shafer et al. | |
| 2013/0104730 | A1 * | 5/2013 | Maier | F02M 59/102 92/61 |
| 2014/0134027 | A1 * | 5/2014 | Schanz | F04B 1/0452 417/559 |
| 2014/0193281 | A1 * | 7/2014 | Shaull | F04B 53/10 417/567 |

FOREIGN PATENT DOCUMENTS

| | | |
|---|---|---|
| EP | 2620633 | 7/2013 |
| JP | S4967022 U | 6/1974 |
| WO | 2009082702 | 7/2009 |

* cited by examiner

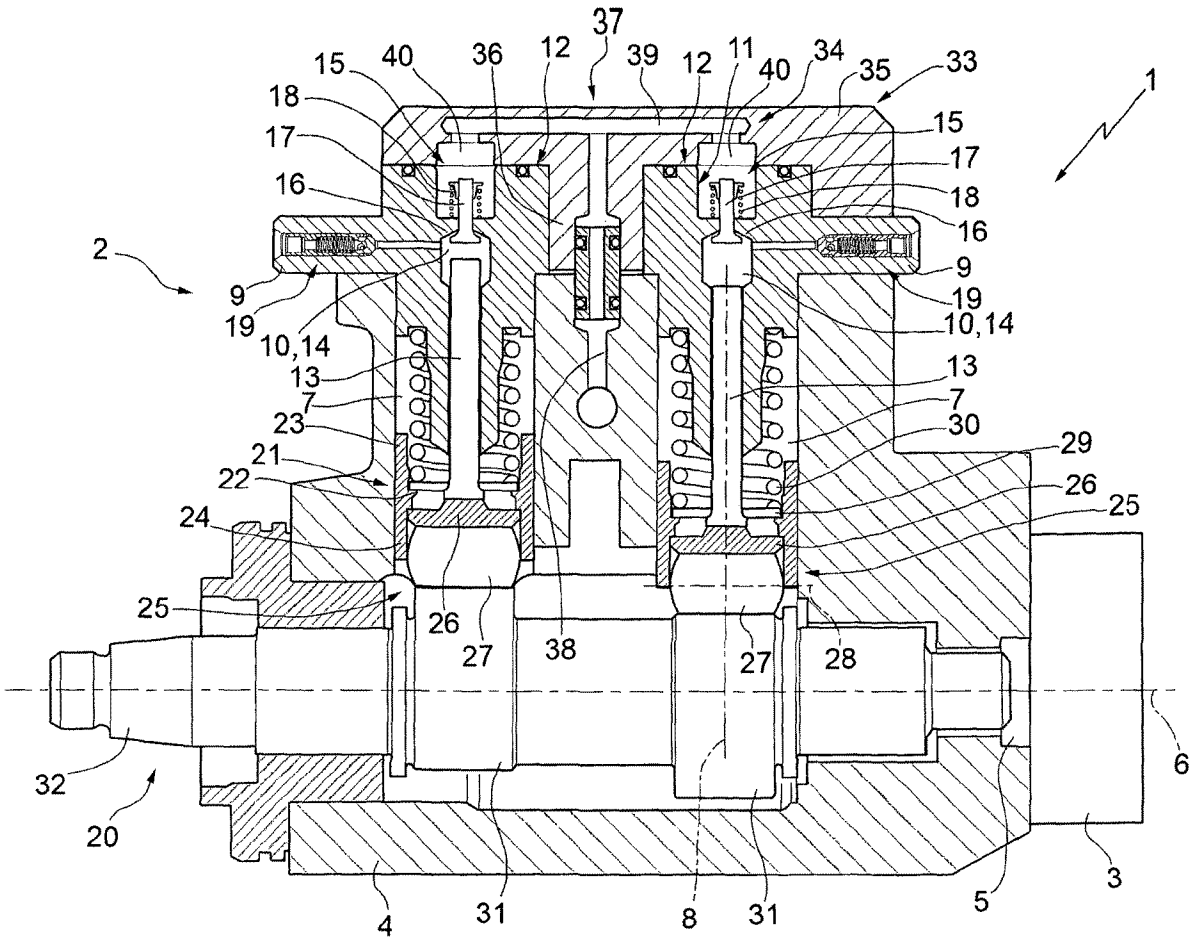
1
2
3
4
5
6
7
8
9
10,14
11
12
13
15
16
17
18
19
20
21
22
23
24
25
26
27
28
29
30
31
32
33
34
35
36
37
38
39
40

PUMP UNIT FOR SUPPLYING FUEL, PREFERABLY DIESEL OIL, TO AN INTERNAL COMBUSTION ENGINE

BACKGROUND OF THE INVENTION

The present invention relates to a pump unit for supplying fuel, preferably diesel oil, to an internal combustion engine.

In particular, the present invention relates to a pump unit of the type comprising a high-pressure pump for supplying the fuel to the internal combustion engine and a pre-supply pump for supplying the fuel to the high-pressure pump.

Generally, the high-pressure pump comprises a pump body having a central bore and at least two lateral bores, which have respective longitudinal axes parallel to one another and perpendicular to a longitudinal axis of the central bore, and face toward this central bore.

Each lateral bore houses within it a tubular head comprising a constricted portion forming a cylinder of the high-pressure pump and a widened portion connected to the constricted portion at an annular shoulder.

The fuel is supplied into the cylinder through an intake valve, which comprises a valve body mounted in the widened portion in contact with the annular shoulder, and has a shutter member mounted through the valve body so as to move between an open and a closed position of the intake valve.

The head is closed axially by a plug screwed into the widened portion to lock the valve body axially against the annular shoulder.

Each head also has a conduit for supplying fuel to the widened portion of the head, and then to the intake valve, and houses within it a delivery valve for selectively controlling the supply of fuel to the internal combustion engine.

The cylinders are slidingly engaged by respective pistons which can move with a reciprocating rectilinear motion along the corresponding cylinders under the force imparted by a drive device, comprising a transmission shaft mounted rotatably through the aforesaid central bore of the pump body and, for each piston, a respective spring interposed between the head and the piston.

Each piston is moved by the corresponding spring in a stroke for the intake of fuel into the corresponding cylinder, and by the transmission shaft in a stroke for the delivery of the fuel from the corresponding cylinder to the internal combustion engine.

Since each head includes the structure of the corresponding supply conduit and the screw thread of the corresponding widened portion, known pump units of the type described above have a number of drawbacks, mainly due to the fact that the production cycle for the corresponding heads is relatively complex and costly.

Furthermore, because of the presence of a closing plug for each head, the pump units have a relatively large number of components and a relatively long assembly time, while, owing to the presence of the conduits for supplying fuel to the cylinders, the overall dimensions and weights of the heads are relatively high.

SUMMARY OF THE INVENTION

The object of the present invention is to provide a pump unit for supplying fuel, preferably diesel oil, to an internal combustion engine which is free of the drawbacks described above and which is simple and economical to produce.

According to the present invention a pumping unit for feeding fuel, in particular diesel fuel, from a storage tank to an internal combustion engine is provided.

BRIEF DESCRIPTION OF THE DRAWINGS

FIG. 1 shows, in cross section and with parts removed for clarity, a pump unit that is a non-limiting exemplary embodiment of the invention.

DETAILED DESCRIPTION

With reference to the attached FIGURE, the number 1 indicates the whole of a pump unit for supplying fuel, preferably diesel oil, to an internal combustion engine (not shown).

The pump unit 1 comprises a high-pressure pump, in the present case a piston pump 2, for supplying the fuel to the aforesaid internal combustion engine (not shown); and a pre-supply pump, in the present case a gear pump 3, for supplying the fuel to the pump 2.

The pump 2 comprises, in the present case, a pump body 4, which is provided with a central bore 5 having a longitudinal axis 6, and is also provided with a plurality of lateral bores 7 (two lateral bores 7 in the present case), which have respective longitudinal axes 8 parallel to one another and perpendicular to the axis 6, and which face toward the bore 5.

Each bore 7 houses within it a tubular head 9, which is fixed to the pump body 4, projects inside the bore 7, and extends around the corresponding axis 8.

Each head 9 comprises a constricted portion forming a cylinder 10 of the pump 2, and a widened portion 11 limited axially by a free end surface 12 perpendicular to the corresponding axis 8 and coplanar with the surface 12 of the other head 9.

Each cylinder 10 is slidingly engaged by a piston 13, which projects outside the cylinder 10 and forms, together with the cylinder 10, a variable-volume chamber 14.

The chamber 14 communicates with the portion 11 via an interposed intake valve 15 comprising a valve body 16, which is incorporated in the head 9, is made in one piece with the head 9, and is formed by an annular flange which projects radially toward the inside of a lateral surface of the head 9 and extends coaxially with the axis 8.

The valve 15 also comprises a shutter member 17 which extends through the valve body 16 coaxially with the axis 8, is movable between an open and a closed position of the valve 15, and is moved to, and normally kept in, its closed position by a spring 18 interposed between the head 9 and the member 17.

The chamber 14 is also connected to a conduit (not shown) for delivering the fuel to the internal combustion engine (not shown) via a delivery valve 19 of a known type formed in the head 9.

The pistons 13 are moved by a drive device 20 along the corresponding cylinders 10 with a reciprocating rectilinear motion, comprising a stroke for the intake of the fuel into the corresponding chambers 14 and a stroke for delivering the fuel to the internal combustion engine (not shown).

The device 20 comprises, for each piston 13, a respective tubular sleeve 21, which is slidingly engaged inside the corresponding bore 7, extends around the corresponding cylinder 10, and has an annular flange 22, which projects radially into the sleeve 21 to divide it into two cylindrical portions 23 and 24, of which the portion 24 faces toward the bore 5.

The device 20 also has, for each sleeve 21, a respective cam follower 25 comprising a coupling block 26 of substantially cylindrical shape, which is fitted inside the corresponding portion 24, is positioned in contact with the corresponding flange 22, and is locked by interference inside the corresponding portion 24.

The cam follower 25 also comprises a cam follower roller 27, which projects from the block 26 toward the bore 5, and is coupled rotatably to the block 26 so as to rotate, relative to the block 26, about its own longitudinal axis 28, which is substantially perpendicular to the corresponding axis 8.

The portion 23 houses within it an annular plate 29, which extends around the piston 13 coaxially with the axis 8, and has an inner perimetric edge facing axially toward the head of the piston 13 and an outer perimetric edge facing the flange 22.

The device 20 also comprises, for each piston 13, a respective cylindrical spring 30, which is mounted inside the corresponding bore 7, and extends between the corresponding head 9 and the corresponding sleeve 21 coaxially with the corresponding axis 8.

The springs 30 are interposed between the corresponding heads 9 and the corresponding plates 29, in order to position, and normally keep, the plates 29 in contact with the corresponding flanges 22 and the corresponding pistons 13; to position, and normally keep, the pistons 13 in contact with the corresponding cam followers 25; and to position, and normally keep, the corresponding rollers 27 in contact with respective cams 31 formed on an outer surface of a transmission shaft 32 mounted through the bore 5 so as to rotate about the axis 6 relative to the pump body 4.

The pump unit 1 also comprises a single cover 33 for closing the widened portions 11 of all the heads 9, and a hydraulic circuit 34 for supplying the fuel to the portions 11 and then to the chambers 14.

The cover 33 comprises a closure plate 35 positioned in contact with the surfaces 12 and a centering shank 36 which projects from the plate 35 perpendicularly to the surfaces 12, and is engaged between the two heads 9.

The circuit 34 is formed entirely outside the heads 9, and comprises a distribution manifold 37 comprising, in turn, in the present case, a first portion 38 formed through the pump body 4 and a second portion 39 formed through the cover 33.

The circuit 34 also comprises, for each cylinder 10, a respective supply conduit 40 formed through the cover 33 to connect the manifold 37 and the corresponding portion 11 to one another.

Since the supply conduits 40 are formed through the cover 33 and not through the heads 9, the heads 9 have relatively small dimensions, overall dimensions and weights.

Since the valve bodies 16 of the intake valves 15 are incorporated into the heads 9, the forces due to the compression of the fuel contained in the chambers 14 act on the heads 9, and not on the cover 33, which can therefore be made of a relatively cheap material such as aluminum or plastic material.

Moreover, the presence of a single cover 33 makes it possible to reduce the number of components and the assembly time of the pump unit 1.

According to some variants which are not shown:

the two heads 9 are dispensed with, and are replaced with a single head including both cylinders 10;

the distribution manifold 37 is dispensed with, and is replaced with a distribution manifold formed entirely through the cover 33; and the cover 33 houses within it at least one flow rate regulation valve for regulating the flow rate of fuel supplied to the cylinders 10.

What is claimed is:

1. A pump unit for supplying fuel to an internal combustion engine, the pump unit comprising a high-pressure pump (2) for supplying the fuel to the internal combustion engine, and a pre-supply pump (3) for supplying the fuel to the high-pressure pump (2); the high-pressure pump (2) comprising at least two cylinders (10) having respective longitudinal axes (8) parallel to one another; a respective piston (13) slidingly engaged in each cylinder (10); a respective at least one head (9) for each cylinder, each head (9) having at least one through bore, which is coaxial with a corresponding longitudinal axis (8), wherein each head comprises a first portion forming a corresponding cylinder (10) and a second portion forming a fuel inlet (11) of the corresponding cylinder (10); and, for each cylinder (10), a respective intake valve (15) interposed between the cylinder (10) and a corresponding inlet (11) to selectively control the supply of fuel to the cylinder (10); each intake valve (15) comprising a valve body (16) and a shutter member (17) movable through the valve body (16) between an open position and a closed position of the intake valve (15); wherein the valve body (16) of each intake valve (15) is formed in one piece with the corresponding head (9), and wherein one cover (33) closes all the inlets (11) of said at least two cylinders, wherein the cover (33) is fixed to the heads (9) of the cylinders, wherein the pump unit further comprises a hydraulic circuit (34) for supplying the fuel to the inlets (11) of the cylinders (10), the hydraulic circuit (34) being formed entirely outside said at least one head (9), wherein the hydraulic circuit (34) comprises a distribution manifold (37) formed at least partially through the cover (33), and, for each inlet (11), a respective supply conduit (40), which extends between the distribution manifold (37) and the inlet (11), and is formed entirely through the cover (33).

2. The pump unit as claimed in claim 1, comprising a plurality of tubular heads (9) equal in number to the number of cylinders (10), each cylinder (10) being formed in a corresponding head (9).

3. The pump unit as claimed in claim 1, wherein said inlets (11) open axially outward at an end surface (12) of said at least one head (9); the cover (33) being mounted in contact with said end surface (12).

4. The pump unit as claimed in claim 1, wherein the hydraulic circuit (34) is formed entirely through the cover (33).

5. The pump unit as claimed in claim 1, further comprising a pump body (4) configured to receive and retain said at least one head (9), the hydraulic circuit (34) being formed partially through the pump body (4) and partially through the cover (33).

6. The pump unit as claimed in claim 1, wherein the hydraulic circuit (34) comprises at least one regulating valve for selectively controlling the flow rate of fuel supplied to said inlets (11), the regulating valve being mounted in the cover (33).

7. The pump unit as claimed in claim 1, further comprising, for each cylinder (10), a respective delivery valve (19) mounted in said at least one head (9) for selectively controlling the supply of fuel to the internal combustion engine.

8. The pump unit as claimed in claim 1, further comprising a drive device (20) for moving the pistons (13) with a reciprocating rectilinear motion along the corresponding cylinders (10); the drive device (20) comprising a transmission shaft (32) mounted to rotate about an axis of rotation (6) perpendicular to the longitudinal axes (8) of the cylinders (10).

9. The pump unit as claimed in claim 1, comprising two said heads (9) which are of tubular shape, extend around the longitudinal axes (8) of the corresponding cylinders (10), and are limited axially by respective end surfaces (12) coplanar with one another and perpendicular to the longitudinal axes (8), the cover (33) comprising a closure plate (35) positioned in contact with the end surfaces (12) and a centering shank (36) which projects from the closure plate (35) parallel to said longitudinal axes (8) and is engaged between the two heads (9).

10. The pump unit as claimed in claim 1, wherein the cover (33) is made of aluminum.

11. The pump unit as claimed in claim 1, wherein the cover (33) is made of plastic.

12. The pump unit as claimed in claim 1, further comprising a pump body (4) with a plurality of bores (7), which have respective longitudinal axes (8) parallel to one another, wherein each bore (7) houses a tubular head (9), which is fixed to the pump body (4), which projects inside the bore (7), and which extends around the corresponding axis (8).

* * * * *